US005129432A

United States Patent [19]

Dugger

[11] Patent Number: 5,129,432

[45] Date of Patent: Jul. 14, 1992

[54] VAPOR COLLECTION ASSEMBLY FOR FUEL DISPENSING NOZZLE

[76] Inventor: Michael D. Dugger, 207 Telfair Ct., Summerville, S.C. 29483

[21] Appl. No.: 703,900

[22] Filed: May 22, 1991

[51] Int. Cl.[5] ..... B65B 1/28

[52] U.S. Cl. ..... 141/1; 220/746; 141/93; 141/44; 141/309; 141/310; 141/392

[58] Field of Search ..... 141/1, 7, 44–46, 141/59, 93, 368, 309, 310, 392, 312; 220/85 VS, 85 VR, 746

[56] References Cited

U.S. PATENT DOCUMENTS

| | | | |
|---|---|---|---|
| 620,877 | 3/1899 | Basett | 141/368 X |
| 2,723,070 | 11/1955 | Merriam | 141/291 |
| 2,874,733 | 2/1959 | Sesler et al. | 141/93 X |
| 3,566,928 | 3/1971 | Hansel | 141/97 |
| 3,710,830 | 1/1973 | Gilson | 141/93 |
| 3,867,969 | 2/1975 | Garnett | 141/59 |
| 3,946,771 | 3/1976 | Braun et al. | 141/59 |
| 4,010,781 | 3/1977 | Sutcliffe | 141/392 |
| 4,060,108 | 11/1977 | Weston et al. | 141/59 |
| 4,747,508 | 5/1988 | Sherwood | 220/86 R |
| 4,765,504 | 8/1988 | Sherwood et al. | 220/86 R |

*Primary Examiner*—Ernest G. Cusick

[57] ABSTRACT

A fuel dispensing nozzle assembly is disclosed for adapting a conventional gasoline pump dispensing nozzle to perform as a Stage II vapor recovery system by effectively collecting the vapors forced out the vehicle fuel tank during a refueling operation. The assembly permits the pump dispensing gun to form a seal with the rim of a vehicle's fill pipe, with operator assistance, to prevent the vapors from escaping into the environment by collecting the vapors within the nozzle assembly, and routing the vapors to a collection tank.

15 Claims, 2 Drawing Sheets

FIG.1
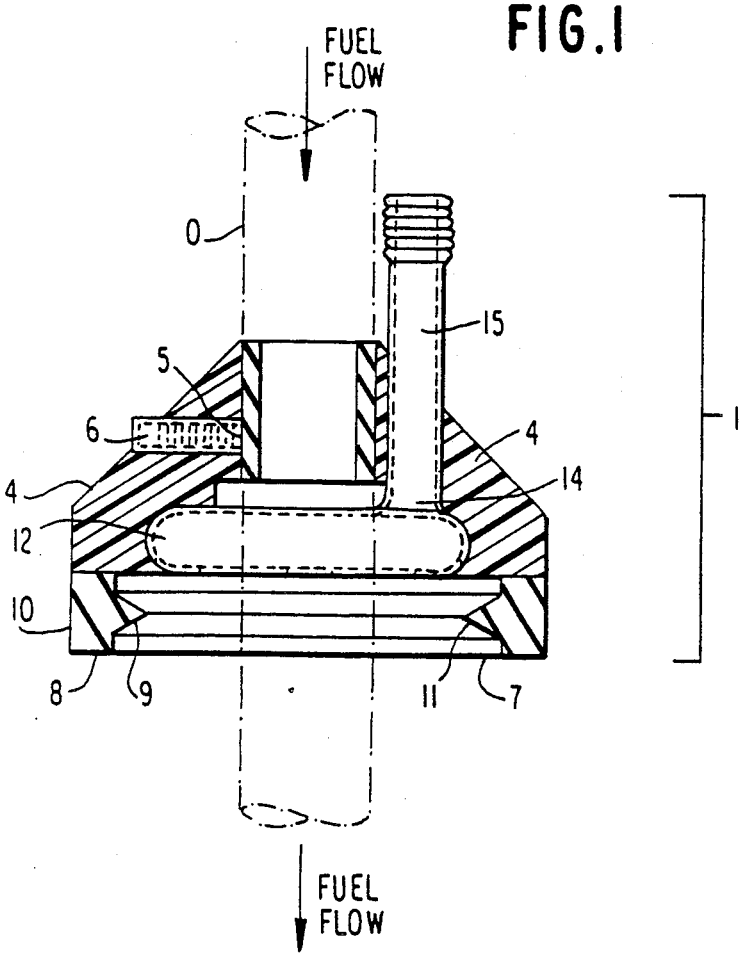
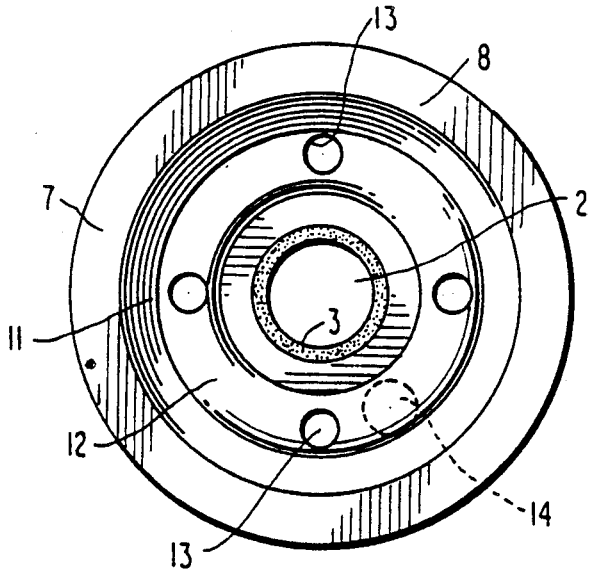
FIG.2

VAPOR COLLECTION ASSEMBLY FOR FUEL DISPENSING NOZZLE

BACKGROUND OF THE INVENTION

1. Field of the Invention

This invention relates generally to vapor recovery control for gasoline pumps and particularly to an improvement to a fuel dispensing nozzle of a conventional service station fuel pump used in replenishing the tank with fuel. The improvement relates to an assembly which attaches to the tubular fuel dispensing nozzle and functions to prevent fuel vapor displaced from the head space of the vehicle fuel tank from being discharged into the atmosphere during a refueling operation.

2. Description of the Prior Art

In the 1920's automobile manufacturers and oil refiners discovered that the addition of tetraethyl lead to gasoline reduced engine "knocking" by slowing the rate at which gasoline ignited. The ability of gasoline to resist knocking is measured by its octane number. The higher the octane number, the greater the resistance to knocking. As the compression ratio of gasoline engines increase, so too does the minimum octane requirement.

During the 1960's oil companies began adding more lead to gasoline in order to increase the octane level of gasoline required by the automobile industry's production of more "muscle cars" (high compression engines with greater horsepower). The increasing amount of lead, however, resulted in a commensurate increase in lead emissions into the environment, creating a major public health hazard.

Partly in response to this hazard Congress, in the Clean Air Act of 1970, established air quality standards for lead and required automobile manufacturers to reduce carbon monoxide and hydrocarbon exhaust emissions through the use of catalytic converters (in 1975). Because leaded gasoline contaminated catalytic converters, oil refiners were forced to manufacture gasoline without lead.

With the mandated phase-out of lead as an octane booster, the major oil companies turned to high-octane aromatics—benzene, toluene, and xylene. Between 1980 and 1988, aromatic content of gasoline increased from about 22 to 32 volume percent. Similarly, the amount of benzene in gasoline also increased sharply over the same period (from about 1.75% to about 2.4%). But benzene, despite its chemical properties and many industrial uses, is a carcinogen. It causes cancer.

By far the most extensive operations resulting in benzene exposure to the general population are gasoline stations, of which there are about 200,000 in the United States. Most of the vapor liberated during a typical fill-up operation results from the displacement of benzene trapped within the gas tank, and not from the gasoline being pumped. Recent measurements in U.S. self-service stations found benzene levels averaging 250 ppb immediately adjacent to the gas pumps. It is estimated that about 37 million people are intermittently exposed to such benzene levels through the use of self-serve facilities. According to the Environmental Protection Agency, consumers who use self-service pumps are regularly exposed to more than one ppm during the time they are in the service-station area. Gasoline attendants, of course, are continuously exposed to them. The Office of Technology Assessment of the U. S. Congress states that refueling emissions are the last significant source of vehicle emissions to remain largely uncontrolled.

Two primary approaches have been taken to deal with this problem: on-board canisters in automobiles and vapor recovery controls for gasoline pumps (Stage II). On-board recovery systems involve canisters of vapor adsorbent material carried on the automobile through which gasoline tank vapors are routed during refueling. Examples are provided in U.S. Pat. Nos.: 4,798,306; 4,809,863; 4,809,865; 4,813,453; 4,815,436; and 4,836,835.

The choice between Stage II vapor recovery systems at gasoline stations and on-board refueling emission control systems on motor vehicles has been debated for over ten years. While both approaches are technologically feasible and cost effective, the California Air Resources Board determined on-board control will not be as effective as the Stage II service station measure at reducing individual fueling risk or reducing areawide and neighborhood benzene exposure for the next 15 to 20 years (until the controlled vehicles replace uncontrolled vehicles). Data demonstrate that vapor recovery systems at the gasoline pump can sharply reduce, by a factor of 10 (from 1.5 ppm to 0.13 ppm), benzene exposure for both motorists and service station attendants.

Implementation of Stage II service station vapor recovery systems has been mandated in only a few states. (In 1987, in order to reduce ambient concentrations of benzene, the State of California finalized regulations requiring refueling controls at all service stations with a monthly gasoline throughput of over 240,000 gallons per year.) The primary obstacles to widespread implementation is the expense and inconvenience of replacing existing equipment. This expense and inconvenience would be minimized by the availability of technology for adapting existing service station pumping equipment to function as a Stage II vapor recovery system.

It is the object of the present invention to provide a fuel dispensing nozzle assembly which, upon attachment to the tubular nozzle of a standard gasoline pump dispensing gun, adapts the pumping unit to act as a Stage II vapor recovery system.

SUMMARY OF THE INVENTION

The above object is achieved in the provision herein of a fuel dispensing nozzle assembly for adapting conventional gasoline pumping equipment to perform as a Stage II vapor recovery system by effectively collecting the vapors forced out the fill pipe of the vehicle fuel tank during a refueling operation. The assembly is designed to fit on the tubular nozzle of a service station gasoline pump dispensing gun in such a way as to form a seal with the rim of a vehicle's fuel tank fill pipe to prevent vapors from escaping into the environment. The assembly is further designed to collect the vapors either by integrating the assembly with existing Stage II recover equipment, where available, or by re-routing the vapors through tubing connected to the gasoline storage tank from which the fuel is being pumped and collecting the vapors and their condensation product therein. Preferably, the storage tank is located underground. This underground storage tank is vented such that the vapors are passed through a treating system, such as a carbon bed, prior to release into the environment.

BRIEF DESCRIPTION OF THE DRAWINGS

FIG. 1 is a cross-sectional view of the fuel dispensing nozzle assembly showing its manner of attachment to the tubular nozzle of a gasoline pump dispensing gun, the assembly being held in place by a set screw.

FIG. 2 is an end view of the fuel dispensing nozzle assembly looking through the assembly from the end which comes in contact with the rim of the fuel tank fill port showing the flat planar surface of the sealing ring, the constricted inner wall of the sealing means, and the openings through which the vapors exiting the fuel tank during filling enter the vapor collection ring for removal to a vapor collection reservoir.

DESCRIPTION OF THE PREFERRED EMBODIMENT(S)

Figure 3:
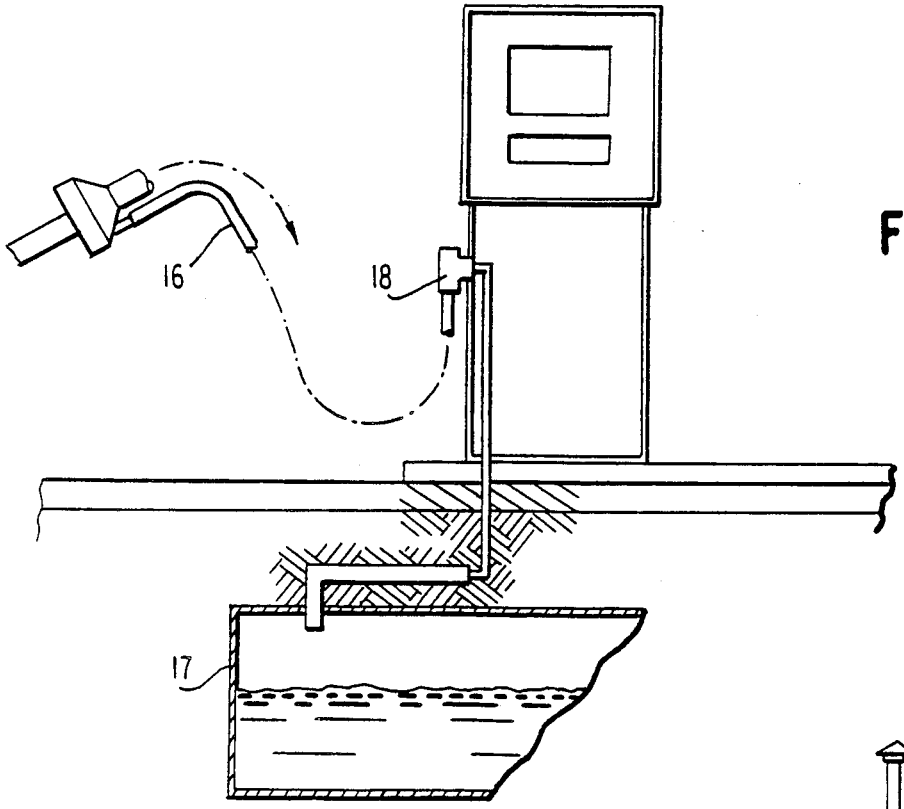
FIG. 3 is a schematic drawing of a gasoline pumping station showing the assembly means for collection in an underground gasoline storage tank of the benzene-containing vapors exiting the head space of the vehicle fuel tank during a refueling operation.

Referring to FIG. 1 there is shown, in cross-section, a tubular nozzle 0 of a gasoline pump dispensing gun with the invention assembly 1 attached thereto. The fuel dispensing nozzle assembly 1 is comprised of a means for attachment to the gasoline dispensing gun nozzle, a means for sealing the forward face of the assembly against the opening rim of a vehicle's fuel tank fill pipe to trap the benzene-containing vapors exiting the fuel tank head space during a refueling operation, a means for collecting the exiting vapors within the assembly, and a means for routing the collected vapors from the assembly to a vapor collection tank.

Referring to FIGS. 1 and 2, the attachment means comprises a centrally and longitudinally located tunnel-like circular aperture or opening 2 through which a forward portion of the tubular dispensing nozzle o may pass. The diameter of the circular opening should be slightly larger than the outside diameter of the gasoline dispensing gun nozzle, permitting insertion of the nozzle therethrough. Midpoint along the length of the opening is positioned a diaphragm constriction 3 for uniformly contacting the nozzle 0 to form a vapor seal. The circular diaphragm 3 is made of a soft, flexible rubber-like material with an opening diameter slightly smaller than the diameter of the nozzle 0. A housing 4, formed generally in the shape of a cone and unifying the sealing means, collection means, and routing means, is constructed of a rigid, durable material to withstand the wear and tear of longterm repeated use. Hard plastics or hard rubber materials or a "Bakelite" material is preferred. The position of the assembly 1 is fixed on the nozzle 0 by at least one pressure point 5 from the housing wall contacting the nozzle 0. The pressure point 5 may be in the form of a spring-loaded pin or ball lying in a horizontal channel 6 in the housing 4 with a notch in the nozzle wall for receiving the pin or ball to hold the assembly 1 in place. Alternatively, the pressure point may be a set screw set in a threaded horizontal channel 6 in the housing 4 for contacting the nozzle 0. Also, preferably, multiple pressure points (spring-loaded pins or set screws) are employed both for added stability of the assembly 1 and to avoid distortion of the diaphragm 3 shape.

The sealing means, located at the forward edge of the assembly (or at the base of the cone-shaped housing) for directly contacting the vehicle fuel tank fill pipe rim, is comprised of a flexible ring 7 having a planar face 8 and flexible (or collapsible) circular walls 9 and 10 both to permit maintenance of contact with the fill pipe rim during minimal movement of the dispensing gun and to direct the vapors exiting the fuel tank toward the rearward portion of the assembly. The inner wall 9 is positioned from the inner edge of the flexible ring planar face 8 to the forward edge of the vapor collection means. The outer sealing means wall 10 is positioned from the outer edge of the flexible ring planar face 8 to the forward edge of the assembly housing 4. The opening of the sealing means should be approximately the diameter of the vehicle fuel tank fill pipe. In the embodiment depicted in FIG. 1, the inner walls 9 of the sealing means comprise a constriction 11 to aid flexing for maintaining contact with the fill pipe rim during refueling. Also, the constriction 11 aids in maintaining said contact if the fill pipe rim fits just inside the sealing means opening. The rearward edge of the sealing means is contacted by the means for collecting the exiting vapors within the assembly.

The collecting means comprises a hollow ring 12 with at least one opening, or inlet port, 13 exposed to the opening of the sealing means such that the exiting vapors passing through the sealing means are received by said opening. The vapor collecting ring 12 is constructed of a fairly rigid rubber or plastic material. The rigidity is necessary to assure that the ring is not pinched closed to preclude movement of the vapors therethrough. Preferably, multiple vapor collection ring receiving openings or inlet ports 13 are provided for efficient vapor removal. Upon collection of the vapors within the vapor collection ring, additional vapors entering the collection ring force the vapors within the ring to exit through an outlet 14 leading to a vapor collection routing tube preferably positioned perpendicular to the plane within which the vapor collection ring 12 lies. The vapor collection routing outlet 14 is necessarily located on the vapor collection ring wall opposite the location of the Vapor collection inlet port(s) 13.

Figure 4:
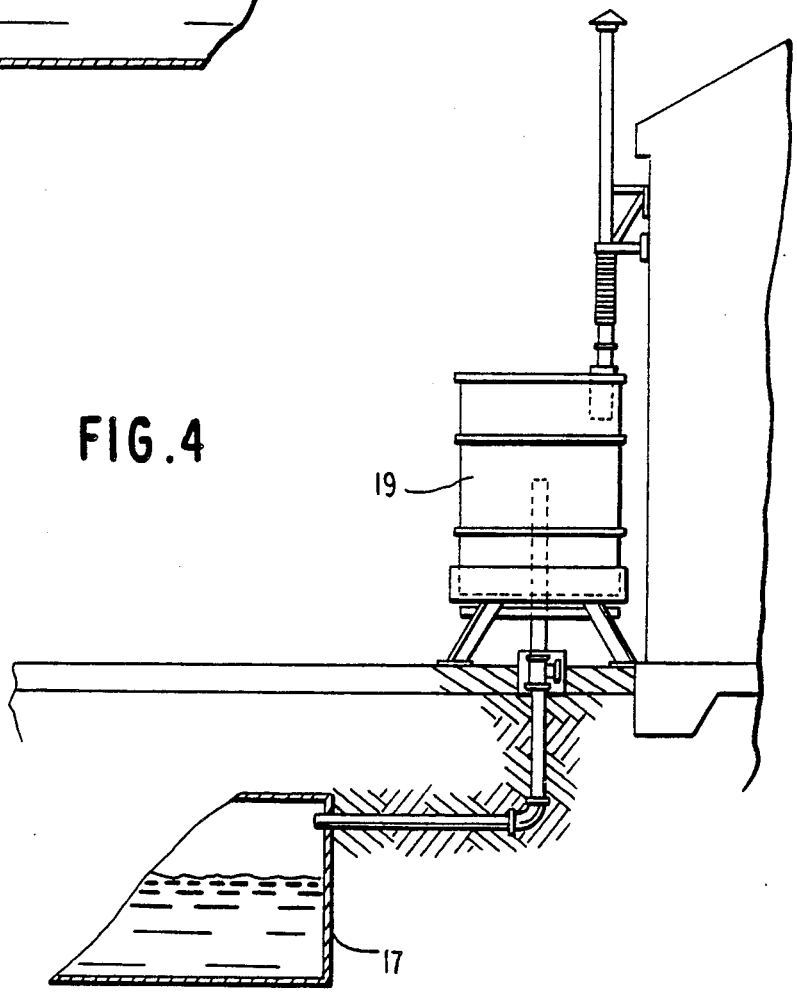
FIG. 4 is a schematic drawing of an underground gasoline storage tank used for vapor collection and showing the means for treating the vapors to remove potentially toxic organic contaminants prior to release into the environment.

The vapor routing means consists of a vapor collection routing tube 15 by which the collected vapors are carried from the vapor collection routing outlet 14 via a hose 16 to an underground vapor collection tank 17. Preferably, the hose and piping leading from the assembly to the underground tank is interrupted by a gravity activated check valve 18 to prevent emission of collected vapors into the environment by backflow through the hose 16 to the assembly 1. The vapor collection routing tube 15 preferably is constructed of the same material as the vapor collection ring 12 The vapor collection tank, depicted in FIGS. 3 and 4, is most conveniently an underground storage tank from which the fuel is being pumped. Thus, vapors enter the head space of the underground tank at the same rate as liquid fuel is pumped from it. As the vapors condense to liquid form they are recycled as fuel. Vapors in the head space of the underground storage tank may be emitted to the environment through a treatment bed for removal of toxic organic compounds normally associated with underground storage tanks at gasoline service stations.

This normally occurs, in a significant volume, only when the underground tank is refilled with fuel.

In an alternative embodiment the vapor routing means is connected with the Stage II vapor recovery system if the service station is so epuipped. The primary difference in such a system is that the vapor collection is facilitated by a negative pressure (vacuum). This also facilitates the seal achieved by the sealing means with the vehicle fuel tank fill pipe rim.

In a further alternative embodiment, in the absence of a Stage II recovery system and where the service station operator objects to recycling the benzene-containing vapors through fuel-containing underground storage tanks (for fear of contamination), an additional storage tank, preferably located underground, may be employed. This tank may be dedicated exclusively for recovering the vehicle fuel tank emitted benzene-containing vapors. Of course, a vapor routing means as shown in FIG. 3 and a vapor treatment system as shown in FIG. 4 are envisioned therefor.

A different perspective of the invention assembly is shown in FIG. 2 which shows an end view of the assembly showing the planar face 8 of the sealing means, the sealing means inner wall 9, the vapor collection ring 12 with four vapor collection inlet ports 13, and the diaphragm 3 for uniformly contacting the nozzle 0 to prevent escape of the vapors directly into the environment.

FIG. 3 shows in schematic form the vapor collection routing means from the vapor collection routing tube 15 via a hose 16 to a return connection to an underground vapor collection tank 17, which may be either the same underground gasoline storage tank from which the fuel is being pumped into the vehicle or another.

FIG. 4 shows in schematic form a typical vapor treatment device 19 for removing toxic organics from the vapor exiting from the head space of the underground Vapor collection tank 17 The treatment device 19 typically is filled With a vapor adsorbant material, such as activated carbon, which acts to strip the toxic organics, such as benzene, toluene, and xylene from the vapors entering from the bottom of the device prior to its exiting from the top of the device via the stack.

The principles of the invention have been described above, but it is realized that a person skilled in the art could devise functional variants and equivalents not specifically described but which would fall within the scope and intent of the invention.

What is claimed is:

1. A fuel dispensing nozzle assembly for adapting a gasoline pump fuel dispensing gun for capturing benzene-containing vapors exiting a vehicle fuel tank during refueling comprising (a) means for attaching the assembly to the dispensing gun nozzle, (b) means for sealing the assembly against a vehicle fuel tank fill pipe rim permitting the fill pipe rim to fit inside the sealing means, said sealing means comprising a flexible ring lying in a plane perpendicular to the length of the nozzle and defining an opening within said plane by an outer edge and an inner edge for receiving the fill pipe rim, a first continuous, flexible circular wall extending from the inner edge of the flexible ring to contain and direct the vapors for collection, and a second continuous, flexible circular wall extending from the outer edge of the flexible ring, (c) means for collecting vapors exiting the vehicle fuel tank during refueling, and (d) means for routing collected vapors from the assembly.

2. The assembly of claim 1 wherein the attachment means comprises (a) a housing for incorporating the sealing means, the vapor collection means, and a portion of the vapor routing means, (b) a centrally and longitudinally located circular opening passing through the housing, the vapor collection means, and the sealing means and exhibiting a diameter just greater than the diameter of the dispensing nozzle.

(c) a circular diaphragm located at about mid-point along the opening and exhibiting a diameter just smaller than the diameter of the dispensing nozzle, and (d) at least one pressure point extending from the housing and contacting the nozzle.

3. The assembly of claim 2 wherein the housing is constructed of a hard rubber material formed in the general shape of a cone the base of which is in contact with the sealing means and wherein the housing is provided near its top with at least one channel parallel with its base running from the housing wall to the circular opening for holding said at least one pressure point for contacting the nozzle.

4. The assembly of claim 3 wherein there is provided one channel and one pressure point wherein the pressure point is a set screw.

5. The assembly of claim 1 wherein the means for collecting vapors comprises:

(a) a hollowed ring comprising at least one vapor collection inlet port opening exposed to the sealing means opening to receive the vapors directed for collection, and (b) an outlet port opening in the hollowed ring wall opposite the inlet port location to permit removal of the collected vapors from the assembly.

6. The assembly of claim 1 wherein the vapor routing means comprises a tube leading from the vapor collection outlet port to the rearward portion of the assembly.

7. The assembly of claim 1 wherein the first continuous, flexible circular wall comprises a constriction to maintain contact with the fill pipe rim upon insertion thereof within the sealing means opening.

8. A method of recovering the benzene-containing vapors emitted from a vehicle fuel tank during a refueling operation employing a service station gasoline pump dispensing gun including a dispensing nozzle for inserting in a vehicle fuel tank fill pipe, said nozzle adapted by attachment thereto of an assembly including means for attaching the assembly to the dispensing gun nozzle, means for sealing the assembly against a vehicle fuel tank fill pipe rim by permitting the fill pipe rim to fit inside the sealing means, means for collecting vapors exiting the vehicle fuel tank during refueling, and means for routing the collected vapors from the assembly, said method comprising (a) inserting the nozzle into the fill pipe to uniformly contact the fill pipe rim against the assembly ring sealing means, said sealing means comprising (i) a flexible ring lying in a plane perpendicular to the length of the nozzle and defining an opening within said plane by an outer edge and an inner edge for receiving the fill pipe rim, (ii) a first continuous, flexible circular wall extending from the inner edge of said flexible ring to contain and direct the vapors for collection and (iii) a second continuous, flexible circular wall extending from the outer edge of the flexible ring, (b) collecting the vapors emitted from the fuel tank during refueling within the assembly vapor collection means, and (c) routing the collected vapors from the vapor collection means through the assembly vapor routing means.

9. The method of claim 8 wherein the means for attaching comprises (a) a housing for incorporating the sealing means, the vapor collection means, and a portion of the vapor routing means, (b) a centrally and longitudinally located circular opening passing through the housing, the vapor collection means, and the sealing means and exhibiting a diameter just greater than the diameter of the dispensing nozzle, (c) a circular diaphragm located at about mid-point along the opening and exhibiting a diameter just smaller than the diameter of the dispensing nozzle, and (d) at least one pressure point extending from the housing and contacting the nozzle.

10. The method of claim 8 wherein the means for collecting vapors comprises (a) a hollowed ring comprising at least one vapor collection inlet port opening exposed to the sealing means opening to receive the vapors directed for collection, and (b) an outlet port opening in the hollowed ring wall opposite the inlet port location to permit removal of the collected vapors form the assembly.

11. The method of claim 8 wherein the vapor routing means comprises a tube leading from the vapor collection outlet port.

12. An improved fuel dispensing nozzle assembly for adapting a gasoline pump fuel dispensing gun to capture benzene-containing vapors exiting a vehicle fuel tank during refueling comprising means for attaching the assembly to the dispensing gun nozzle, means for sealing the assembly against a vehicle fuel tank fill pipe rim, means for collecting vapors exiting the vehicle fuel tank during refueling, and means for routing collected vapors from the assembly wherein the improvement comprises permitting the fill pipe rim to fit inside the sealing means, said sealing means including (i) a flexible ring lying in a plane perpendicular to the length of the nozzle and defining an opening within said plane by an outer edge and an inner edge for receiving the fill pipe rim, (ii) a first continuous, flexible circular wall extending from the inner edge of said flexible ring to contain and direct the vapors for collection and (iii) a second continuous, flexible circular wall extending from the outer edge of the flexible ring.

13. The improved assembly of claim 12 wherein the means for attaching comprises (a) a housing for incorporating the sealing means, the vapor collection means, and a portion of the vapor routing means, (b) a centrally and longitudinally located circular opening passing through the housing, the vapor collection means, and the sealing means and exhibiting a diameter just greater than the diameter of the dispensing nozzle, (c) a circular diaphragm located at about mid-point along the opening and exhibiting a diameter just smaller than the diameter of the dispensing nozzle, and (d) at least one pressure point extending from the housing and contacting the nozzle.

14. The improved assembly of claim 12 wherein the means for means for collecting vapors comprises (a) a hollowed ring comprising at least one vapor collection inlet port opening exposed to the sealing means opening to receive the vapors directed for collection, and (b) an outlet port opening in the hollowed ring wall opposite the inlet port location to permit removal of the collected vapors from the assembly.

15. The improved assembly of claim 12 wherein the vapor routing means comprises a tube leading from the vapor collection outlet port.

* * * * *